United States Patent [19]

Benjamin et al.

[11] Patent Number: 4,919,383

[45] Date of Patent: Apr. 24, 1990

[54] ROTATING DISPLAY

[75] Inventors: Olivier Benjamin, Woodcliff Lake; Robert P. Franklin, Lake Hopatcong; John Larocca, Fairfield, all of N.J.

[73] Assignee: Trans World Marketing Corp., E. Rutherford, N.J.

[21] Appl. No.: 330,440

[22] Filed: Mar. 30, 1989

[51] Int. Cl.[5] ..... A47B 95/00

[52] U.S. Cl. ..... 248/349; 248/417

[58] Field of Search ..... 248/417, 415, 349, 131, 248/144, 145; 40/613, 446; 211/163

[56] References Cited

U.S. PATENT DOCUMENTS

| | | | |
|---|---|---|---|
| 1,918,190 | 7/1933 | Miller et al. . | |
| 2,084,818 | 6/1937 | Neil . | |
| 3,142,471 | 7/1964 | Silver . | |
| 3,199,826 | 8/1965 | Miller et al. | 248/349 X |
| 3,204,915 | 9/1965 | Silver . | |
| 3,224,724 | 12/1965 | Allred . | |
| 3,491,978 | 1/1970 | Battocchio | 248/417 |
| 3,537,675 | 11/1970 | Cycowicz | 248/417 |
| 4,566,664 | 1/1986 | Donald | 248/349 |
| 4,738,422 | 4/1988 | Matheson et al. | 248/349 X |

*Primary Examiner*—Ramon O. Ramirez

*Attorney, Agent, or Firm*—Ostrolenk, Faber, Gerb & Soffen

[57] ABSTRACT

Rotating displays include rotation mechanisms which allow the displays to be easily rotated by consumers, yet automatically returned to one or more desired positions when released by the consumer. Holders for the display are affixed to turntables rotatably mounted upon a base wherein the turntables are attached to a biasing means capable of exerting a sufficient torque upon said turntable, relative to said base to cause an angular acceleration of said turntable toward a predetermined desired orientation. In preferred embodiments, the amplitude of the torque may be adjusted, depending upon the moment of inertia of the display, to cause a predetermined angular acceleration. The number and placement of equilibrium orientations may be selected based upon the desired geometric configuration of the display with which the rotation mechanism is to be used.

15 Claims, 6 Drawing Sheets

ROTATING DISPLAY

BACKGROUND OF THE INVENTION

FIELD OF THE INVENTION

This invention relates to rotating displays and to rotation mechanisms onto which such displays may be mounted, and more particularly to displays and mechanisms which may be easily rotated by consumers and which automatically return to a predetermined position when released by the consumer.

Displays used for marketing purposes may contain, for example, advertising materials, working models or a product arranged in an attractive manner on the display. In many instances, for reasons of space efficiency as well as effective marketing, it may be desirable to place information, products or the like in large quantities on a single display. Hence, it is often desirable to utilize a circular or polygonal display holder wherein products or materials to be displayed are placed along all sides of the holder. When a display is arranged in this manner it is desirable that the display be capable of rotation such that a viewer approaching from one side may, without moving, easily rotate the display to view any of the other sides.

For many applications, it is desirable that the rotating display, prior to rotation, be oriented in a predetermined starting position. For example, in a room where the physical layout makes it highly likely that a consumer will initially approach the display from a particular direction, the side of the display most likely to attract a consumer's attention should desirably face the likely direction of consumer approach. In some applications a display may set forth information which is best viewed in a sequential manner, and of course would desirably be oriented such that the initial information of the sequence faces the expected direction from which consumers are likely to approach.

A problem with rotating displays is that, while they make it convenient for a consumer to view all sides, they are often rotated to a less than desirable starting position from which to attract the next consumer who passes the display. Hence, there is a need for displays capable of automatically rotating to a desired predetermined orientation.

U.S. Pat. No. 3,142,471 discloses the use of a complex two-spring mechanism for biasing a swivel chair to face a given direction. Other swivel chair mechanisms are discussed in U.S. Pat. Nos. 3,204,915, 1,918,190 and 3,224,724. U.S. Pat. No. 2,084,818 discloses a billboard whose panels may pivot to avoid excessive wind pressure. None of these patents disclose rotating displays automatically returnable to predetermined starting positions. Nor do they disclose inexpensive, high durability rotation mechanisms for such displays. The swivel chain art does not take into account rotation problems which may be unique to displays. For example, it is desirable for aesthetic reasons that the rotation mechanism at the base of a display be very close to the ground or countertop on which the display is placed. It is also usually desired, for both aesthetic and functional reasons, that a rotating display rotate slowly. For example, if lightweight products are loosely affixed to a display, they may be dislodged by excessive rotating speeds or by an abrupt halt at the conclusion of rotation should the display "snap" back to a starting position. Simple mechanisms with relatively few moving parts likely to require replacement are needed for use in displays. In addition to the durability of such mechanisms, they may be mass produced much more efficiently than may more complex mechanisms.

For many purposes, more than one initial orientation would be suitable. For example, if the display were a two-sided poster, either of two starting orientations (where one poster side or the other faces the likely direction of consumer approach) would be preferred. Where there are alternative appropriate initial positions, it may be useful for the display to be randomly oriented in *any* of such positions. A consumer whose interest was not attracted upon first passing the display may nontheless become interested upon subsequently passing the display after it has been rotated to show a different face.

BRIEF DESCRIPTION OF THE INVENTION

It is accordingly an object of the present invention to provide a rotating display, and a rotation mechanism for mounting such a display, which is capable, after rotation, of automatically assuming an appropriate predetermined orientation.

It is another object of the invention to provide a rotating display (and related rotation mechanism) capable of automatically rotating to a desired position at a predetermined rotation rate.

It is another object of the invention to provide rotation mechanisms for displays which are durable and are comprised of a limited number of moving parts likely to require replacement.

It is another object of the invention to provide rotation mechanisms which may be efficiently mass produced.

It is another object of the invention to provide rotation mechanisms, for displays, which are aesthetically pleasing and/or do not disrupt or diminish the aesthetic effect to be achieved with the display.

The above and other objects are achieved by providing a rotation mechanism for a rotatable display comprising a turntable rotatably mounted upon a base and free to rotate about an axis of rotation to at least one predetermined equilibrium orientation relative to said base, said base having a cam with a contact surface which is non-uniform about said axis of rotation, said turntable having attached thereto, first and second pressure arms each pivotably mounted to said turntable, wherein first and second cam followers are rotatably mounted to said first and second pressure arms respectively, both cam followers being pressed against said contact surface by a single biasing means and with a force sufficient to cause, in the absence of external force or impediment, an angular acceleration of said turntable, relative to said base, in a direction toward one of said equilibrium orientations. Hence, after a consumer rotates a display utilizing such a rotation mechanism, the rotation mechanism automatically causes the display to assume a desired orientation.

In certain preferred embodiments, the rotation mechanism comprises a plurality of alternative equilibrium orientations. Where there are a plurality of such orientations, the particular one to which the mechanism will automatically rotate depends upon the orientation of the display just prior to its being released for free rotation. In certain preferred embodiments of the invention, all equilibrium orientations are equidistant from adjacent equilibrium orientations. Preferably, the biasing means causes rotation to the nearest equilibrium orientation, thus achieving such orientation with the least possible rotation.

The present invention is also directed toward rotatable displays comprising a display holder attached to a turntable of a rotation mechanism as described above, such that said holder and turntable are capable of rotating in tandem.

In certain preferred embodiments of displays formed in accordance with the invention, the lower surface of the turntable is maintained relatively close to the lower surface of the base, preferably less than one inch, for example, about 0.45 inches to about 0.65 inches. This establishes a relatively small clearance between the bottom of the rotating turntable and the counter floor or other surface on which the display is resting. This may improve the overall appearance of the display and decrease the fraction of the overall height of the display which is contributed by the rotation mechanism. Hence, a large percentage of the display is available for aesthetic and marketing purposes. This is achieved while still allowing sufficient clearance between the turntable and the countertop, floor or other surface on which the display is resting. In some embodiments, the turntable may itself include structures capable of acting as a display holder. In other words the turntable and display holder may be integrally formed as a single structure.

In certain preferred embodiments the rotatable display includes a display holder having a polygonal cross section wherein the turntable has a number of equilibrium orientations relative to the base which are determined by the quotient A/B, wherein A is the number of polygonal sides in the polygonal cross section and B is any positive integer which may be divided evenly into A. For example, an octagonal display having eight faces, any one of which may desirably face the direction of likely consumer approach may desirably have eight equilibrium orientations which are equidistant from each other. Proper placement of such a display would result, after rotation by a consumer has been terminated, in the display automatically assuming an equilibrium orientation wherein one of the eight faces of the octagonal display is turned toward the consumer approach direction. For an octagonal display, a similar result is achievable using one, two or four equidistant equilibrium orientations. In each of these cases the display would be capable of reorienting such that one of the eight sides directly faces a likely direction of consumer approach. For a hexagonal display, six, three, two or one equilibrium orientations would be preferred.

As used herein, a "display holder" is intended to include any structure visually presenting the products, information, drawings, models or the like for which visual display to consumers is desired. The display holder may itself be part or all of the desired visual presentation, or alternatively, may provide surfaces, ledges or other means for receiving or attaching to that which is to be displayed.

BRIEF DESCRIPTION OF THE DRAWINGS

For the purpose of illustrating the invention, there is shown in the drawings several embodiments which are presently preferred, it being understood, however, that this invention is not limited to the precise arrangements and instrumentalities shown.

DETAILED DESCRIPTION OF THE PREFERRED EMBODIMENTS

Figure 1:
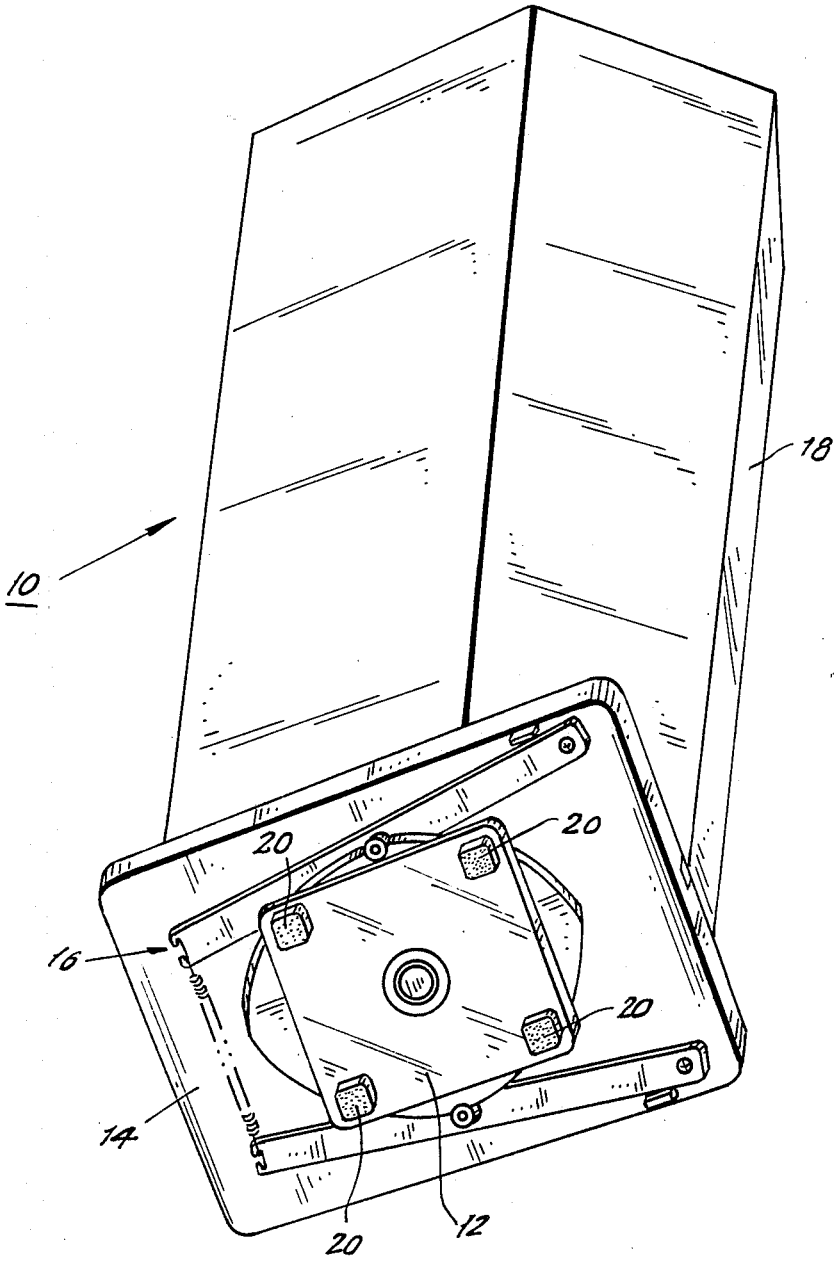
FIG. 1 is a bottom perspective view of a rotatable display constructed in accordance with the present invention.

Referring now to the drawings wherein like numerals indicate like elements, there is shown in FIG. 1 a rotating display constructed in accordance with the principles of the present invention and designated generally as 10. Rotating display 10 includes a base 12, a turntable 14, a rotating mechanism 16 rotatably connecting the turntable 14 to the base 12 and a display case 18 fixedly supported on the turntable 14.

The base 12 is preferably formed as a flat rectangular member having four cushioning pads 20 located at respective corners thereof. Pads 20 are preferably comprised of rubber or other material having a high coefficient of static friction. During use of top surface of the floor, countertop or other surface on which the display 10 has been placed and, due to their high coefficient of static friction, maintain the base 12 substantially motionless relative to said floor or countertop, etc.

The turntable 14 is connected to the base 12 by a rotating mechanism 16 described in greater detail below. The rotating mechanism 16 permits the turntable 14 to be rotated relative to the base 12 by an individual viewing the products in the display case 18 and, therefore, relative to the support surface upon which the display 10 is located. In this way, the individual can view any of the material located in the case at his or her discretion.

Figure 7:
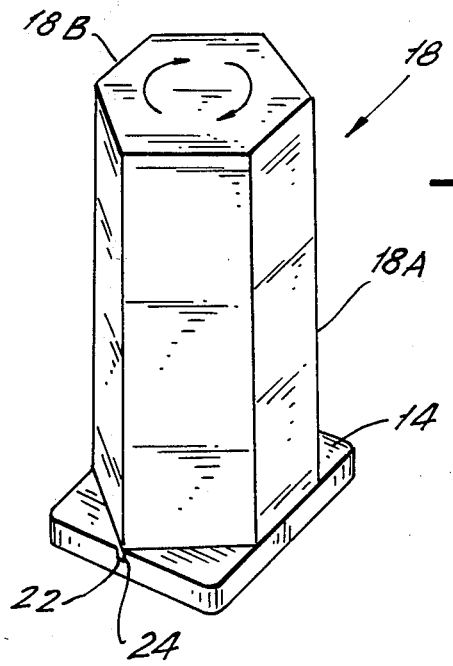
FIG. 7 is a top perspective view of the rotatable display of FIG. 1.

While it is desirable for the individual to be able to view any portion of the display case 18 which he or she desires, it is also desirable for the display case to be set at a predetermined orientation when the individual has stopped rotating the display case. Referring to FIG. 7, the display case 18 preferably takes the form of a hexagonal member. The retailer displaying goods in the display case 18 may wish to ensure that the sides 18A and 18B are located in the positions illustrated in FIG. 7 if these sides display the products which the retailer wishes to display most prominently. It also may be desirable to return the display case 18 to this position to ensure that advertising information (possibly formed on portions of faces 18A and 18B) face in a desired direction. The rotating mechanism 16 simultaneously ensures that the individual viewing the products in the display case 18 can easily rotate the same while at the same time ensuring that the display case 18 will return to one or more predetermined equilibrium positions when the individual releases the display case 18.

As shown in FIG. 7, the display case 18 preferably takes the form of a hexagonal display case formed of a clear material so that products contained in the display case 18 can be viewed. In a typical application, at least one of the sides of the display case may be opened so that the individual viewing the display case may remove material in the display case for further examination. Alternatively, the products to be display may be supported on the outside of the display case, for example, by suitable hooks. While it is preferable that the rotating display 10 of the present invention included a display case such as that illustrated in the figures, any other item to be displayed (for example, a multi-feed sign) may be provided. Indeed, the present invention is broad enough to include merely the base, turntable and rotational mechanism without a display being located thereon.

Figure 2:
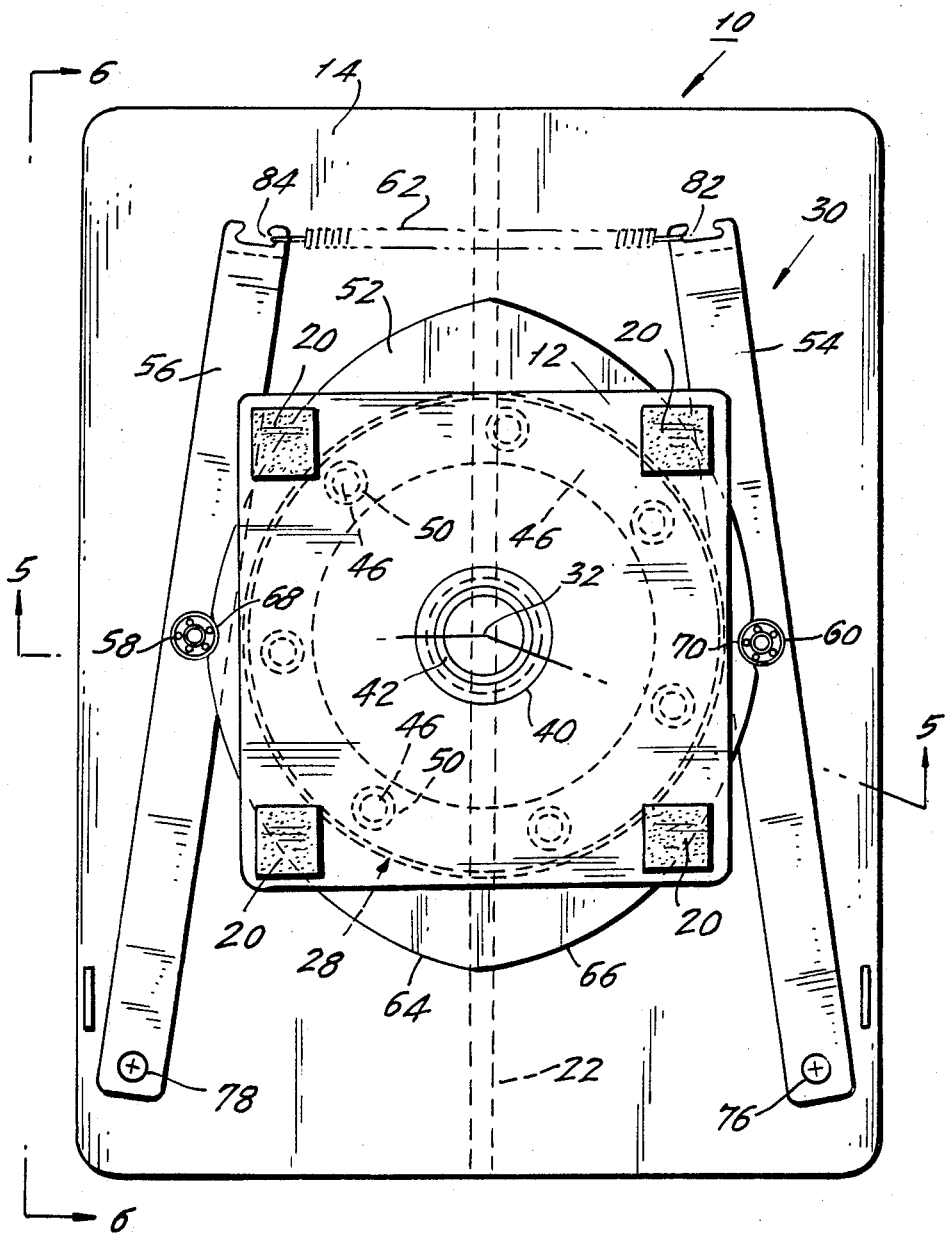
FIG. 2 is a bottom view of the display of FIG. 1 wherein the display case is at a predetermined equilibrium position with reference to the base of the display.
Figure 3:
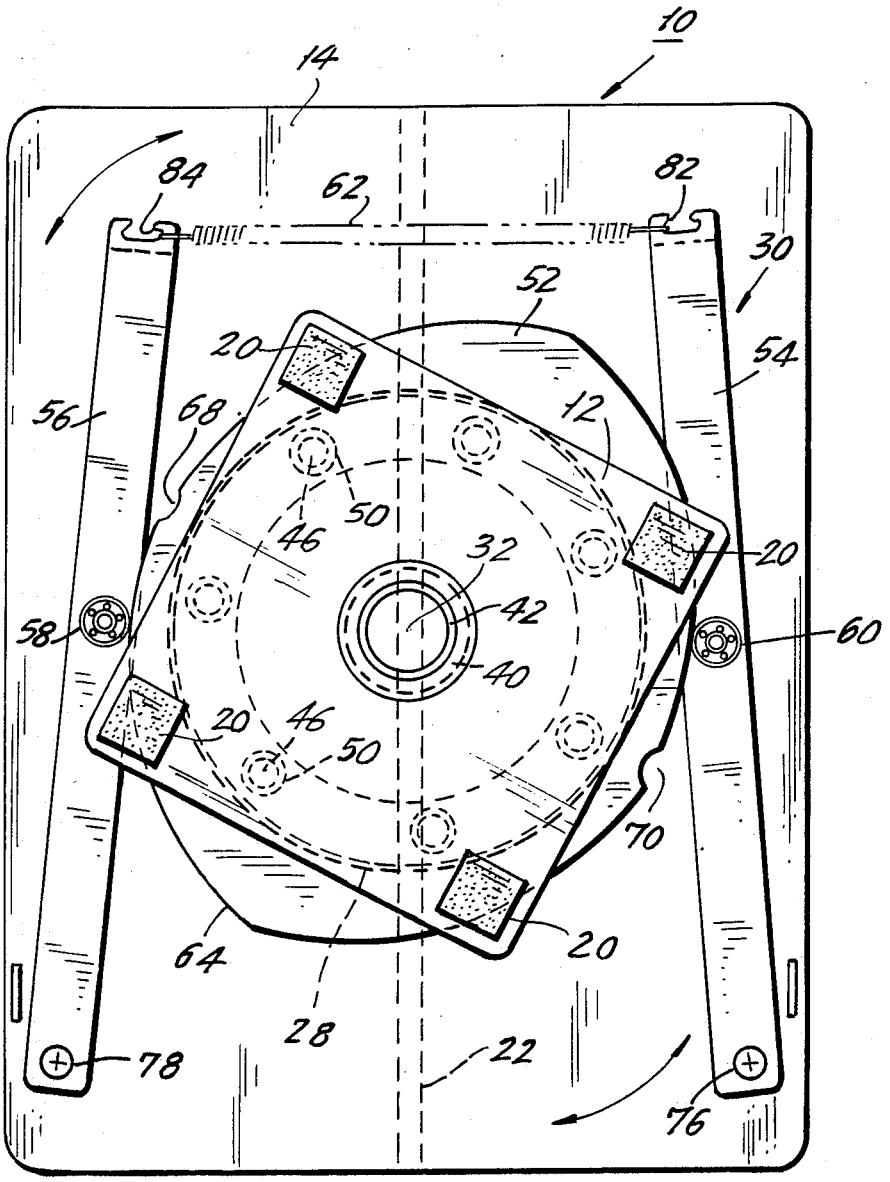
FIG. 3 is a bottom view of the display of FIG. 1 wherein the display case has been rotated away from equilibrium position relative to the base of the display.
Figure 5:
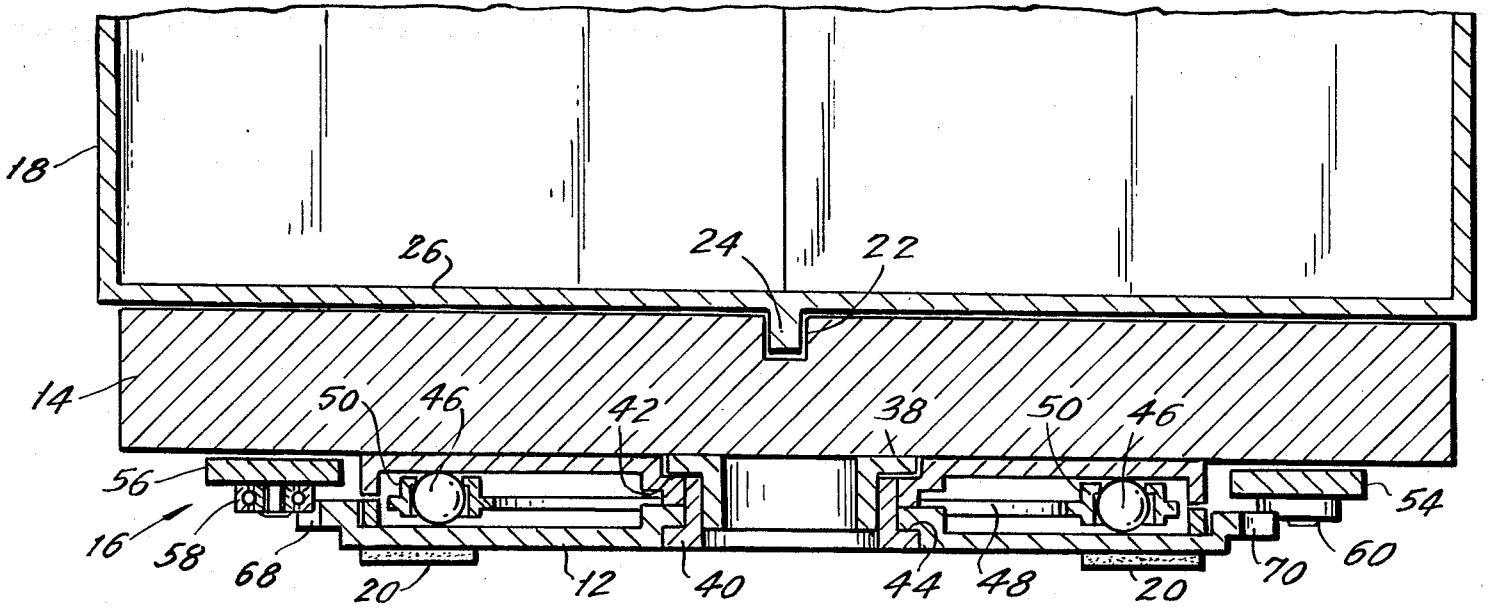
FIG. 5 is a sectional view of the rotating display of FIG. 1 taken along line 5—5 of FIG. 2.
Figure 6:
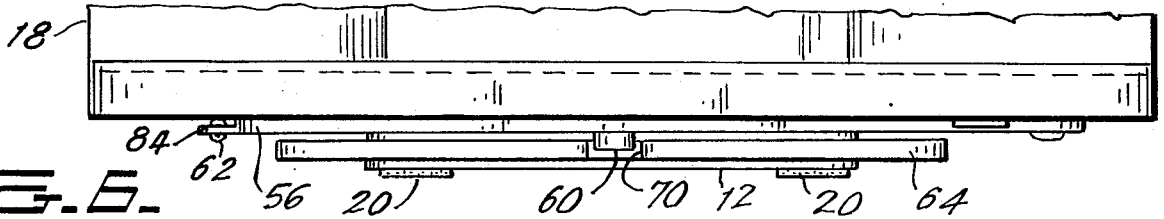
FIG. 6 is a side view, partially broken away, of the rotary display of FIG. 1.

When a display case 18 is provided, it should be fixedly connected to the turntable 14 so that it rotates with the turntable 14. To this end, a groove 22 is preferably formed in the top surface of turntable 14 as best shown in FIGS. 2 and 5. A corresponding projecting member 24 extends from the bottom wall 26 of the display case 18 and is inserted into the groove 22 so as to ensure that the display case 18 rotates as a single member with turntable 14. The display case 18 may be fixedly coupled to the turntable 14 by any suitable means such as adhesive.

As best illustrated in FIGS. 2–5, the rotating member 16 comprises a ball bearing mechanism 28 and a return mechanism 30. The ball bearing mechanism 28 ensures that the turntable 14 rotates freely with respect to the base 12 about a rotary axis 32 which corresponds to the central axis of the display case 18. The return mechanism 30 serves as a biasing mechanism to return the turntable to one of a plurality of predetermined rest positions relative to base 12 whenever an individual who had previously rotated the display case 18 removes the external force from the display case 18.

The ball bearing mechanism 28 includes a housing defined by the upper surface of base 12, cylindrical member 34 which is permanently attached to base 12 (for example by an adhesive) and upper housing member 36 which is preferably permanently attached to turntable 14. These elements of the ball bearing housing are preferably coupled together by male and female coupling members 38, 40, which are received in respective nesting reeesses 42, 44 which are formed in the upper housing member 36 and base 12, respectively. As best shown in FIG. 5, the male and female coupling members 38, 40 (which are preferably glued together) hold elements 12, 34 and 36 together to define the housing of the ball bearing mechanism 28.

Figure 4:
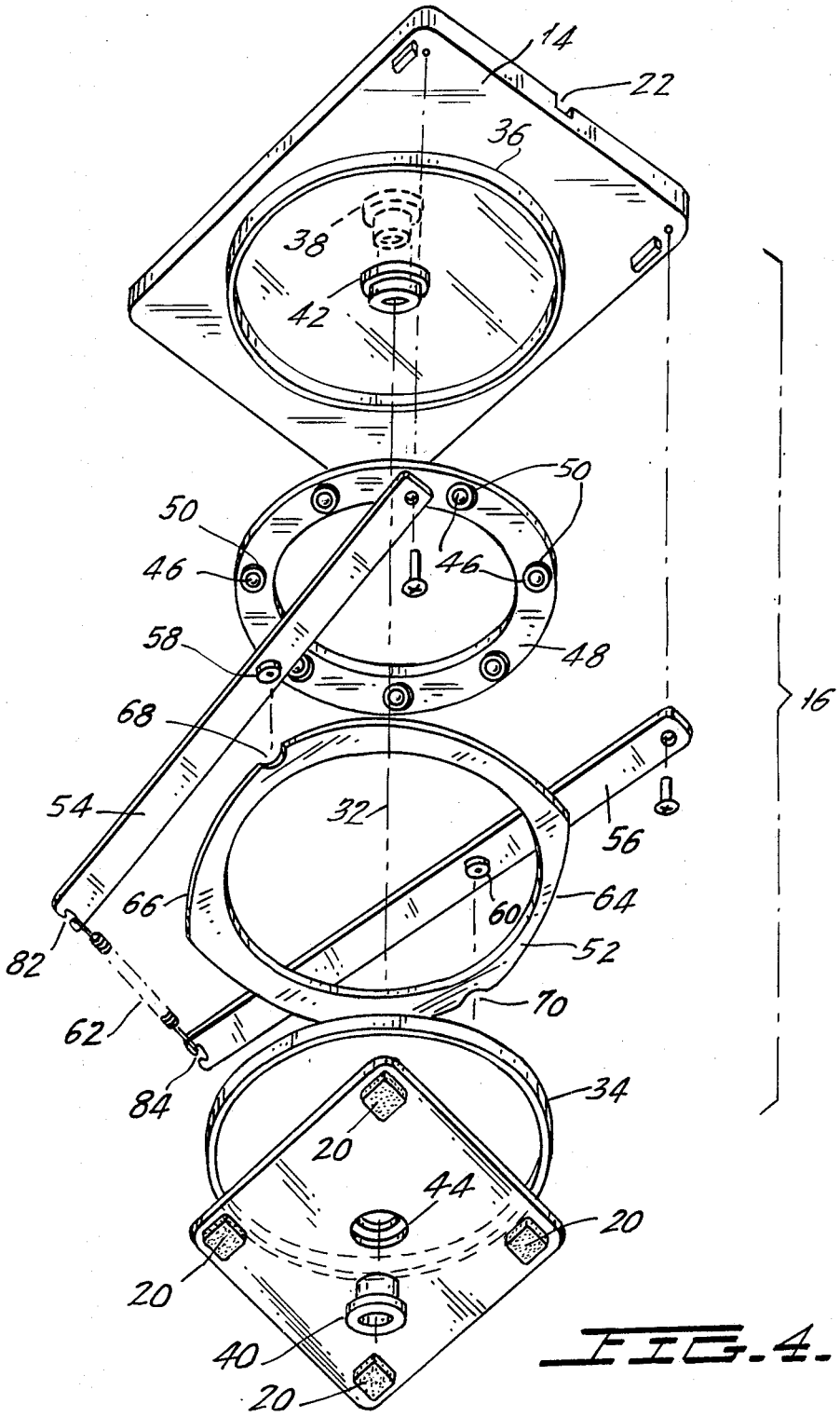
FIG. 4 is an exploded view (partially broken away) of the display of FIG. 1.

As best shown in FIGS. 4 and 5, a plurality of balls 46 are received in cage 48 which is in turn housed in the ball bearing housing. Each of the balls are received in a respective stepped opening 50 formed in the cage 48 so as to locate the balls at equal spaced locations about the cage 48. Step openings 50 are extended through the cage 48 so that the top surface of the balls 46 can contact the bottom planar surface of the upper housing member 36 and the bottom surface of the balls 46 contact the upper planar surface of the base 12. This structure ensures that the turntable 14 (and therefore the support structure upon which the rotating display 10 is located) can rotate freely and smoothly with respect to the base 12.

The return mechanism 30 includes a cam member 52, a pair of pivoted arms 54, 56, a pair of cam followers 58, 60 located on the arms 54, 56, respectively, and a tension spring 62.

The cam member 52 is fixedly coupled to the base 12, for example, by gluing. The cam member 52 has a pair of arcuate cam surfaces 64, 66, each of which has a respective detents 68, 70 formed therein. As will be described below, each of the detents 68, 70 will define an equilibrium position for the rotating mechanism 16. The arcuate cam surfaces 64, 68 are located at varying radial distances from the axis of rotation 32 about which the rotating mechanism 16 rotates the turntable 14. The distance of the arcuate cam surfaces 64, 66 from the axis of rotation 37 is greatest at the apex points 72, 74 at which the cam surfaces 64, 66 meet and is least at the detents 68, 70.

The arms 54, 56 are pivotally connected to turntable 14 by screws 76, 78 or other suitable means. The distal end of arms 54, 56 are biased towards each other by tension spring 62, the opposite ends of which are received in hooks 84, 82, respectively. This tension spring 62 serves to bias the cam followers 58, 60 in to firm contact with the cam surfaces 64, 66 of the cam member 52. Since the distance of the cam surfaces 64, 66 to the central axis 32 about which the display is rotated is least at the location of the detents 68, 70, of the return mechanism 30 will return the turntable 14 to the rest position illustrated in FIG. 2 or to a rest position wherein the turntable 14 is rotated 180° relative to its position illustrated in FIG. 2 (i.e., where the screws 76, 78 will be located on the top of FIG. 2 and the spring 62 will be located on the bottom thereof) whenever the external rotary force is removed from display case 18. This operation can best be understood by comparing FIGS. 2 and 3 of the drawings. In FIG. 4, the turntable 14 has been rotated (by an individual viewing products in the display case 18) from the equilibrium position of FIG. 2 by approximately 20°. For the purpose of ease illustration, the base 12 is illustrated as having been rotated relative to the turntable member 14. In actual use, the base 12 will be maintained at a stationary position and the turntable 14 will have been rotated. In this position, the distance of the cam followers 58, 60 from the rotary axis 32 has been increased due to the arcuate nature of the cam surfaces 64, 66. As a result, the distal ends of arms 54, 56 will be increased and the tension spring 62 will be pulled apart. This effect is increased as the turntable 14 is rotated further from the equilibrium position and is at a maximum at the apex points 72, 72.

Whenever the individual who has rotated the display case 18 lets go of the display case 18, the tension spring 62 will pull the distal ends of arms 54, 56 together which will, in turn, cause the turntable 14, and with it the display case 18, to rotate back to the equilibrium position of FIG. 2. If the display case 18 had been rotated by a sufficient distance that the cam followers 58, 60 were in contact with cam surfaces 64, 66, respectively, then the return mechanism 30 will return the turntable 14, and with it the display case 18, to the rest position 180° removed from that illustrated in FIG. 2.

Figure 8:
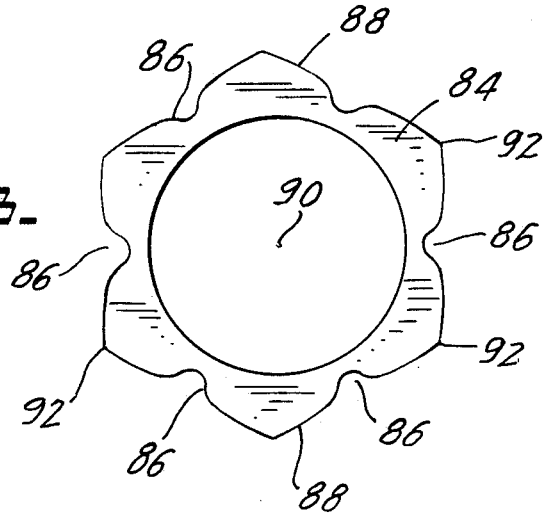
FIG. 8 sets forth an alternative cam which forms part of the rotary mechanism of the rotating display of FIG. 1.

In the preferred embodiment, two equilibrium points are provided. If desired, a greater number of equilibrium points can be provided. For example, alternative cam 84 shown in FIG. 8 may be utilized to provide six different equilibrium points corresponding to the detents 86 all of which are equidistant from one another in the preferred embodiment shown. Preferably the non-uniformity of cam surface 88 about axis of rotation 90 is such that cam surface 88 reaches its greatest distance from axis 90 at positions 92 which is equidistant between two detents 86. Such a cam, when utilized in conjunction with preferred rotation mechanisms of the invention, causes the torque exerted upon the turntable to be in a direction toward the nearest of the detents 86. This provides automatic return to a desired equilibrium orientation with the smallest degree of rotation.

It will be appreciated that the amplitude of the torque exerted upon turntable 14 relative to base 12 by the rotating mechanism 16 may be selected to match the particular load provided by display case 18 and the articles located therein. For example, in the preferred embodiment illustrated by FIGS. 2—4, a required torque amplitude may be provided by selecting a spring 62 having a spring constant which matches the load in question. Alternatively, the spring length, or the distance between hooks 80, 82 may be altered to increase or decrease the initial load. Alternatively, the distance of the cam surfaces 64, 66 from the axis 32 may be increased or decreased. Those of skill in the art will appreciate numerous other methods of altering torque amplitude.

Rotation mechanisms produced in accordance with the invention should desirably have different torque amplitudes depending upon the anticipated final use. Higher torque is necessary for use with displays expected to be heavy, or to extend large distances from the axis of rotation, or to otherwise have high moments of inertia. In preferred embodiments, the torque provided by the rotation mechanism relative to the moment of inertia of the display is adjusted to provide an average angular acceleration of between about 20° per second per second and about 70° per second per second.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A rotation mechanism comprising a turntable rotatably mounted upon a base and free to rotate about an axis of rotation to at least one predetermined equilibrium orientation relative to said base, said base having a cam with a contact surface which is non-uniform about said axis of rotation, said turntable having attached thereto, first and second pressure arms each pivotably mounted to said turntable, wherein first and second cam followers are rotatably mounted to said first and second pressure arms respectively, both cam followers being pressed against said contact surface by a single biasing means and with a force sufficient to cause, in the absence of external force or impediment, an angular acceleration of said turntable, relative to said base, in a direction toward one of said equilibrium orientations.

2. The rotation mechanism of claim 1 comprising a plurality of said equilibrium orientations.

3. The rotation mechanism of claim 1 comprising at least three of said equilibrium orientations.

4. The rotation mechanism of claim 1 wherein each of said equilibrium orientations are equidistant from adjacent equilibrium orientations.

5. The rotation mechanism of claim 1 wherein said angular acceleration is in a direction toward the nearest of said equilibrium orientations.

6. The rotation mechanism of claim 1 wherein said biasing means comprises a single spring which causes said first and second pressure arms to press said first and second cam followers against said contact surface of said cam.

7. The rotation mechanism of claim 1 wherein a lower surface of said base is located between about 0.45 inches and about 0.65 inches from said turntable.

8. A rotatable display comprising a display holder attached to a turntable such that said holder and turntable are capable of rotating in tandem, said turntable being rotatably mounted upon a base and free to rotate about an axis of rotation to at least one predetermined equilibrium orientation relative to said base, said base having a cam with a contact surface which is non-uniform about said axis of rotation, and turntable having attached thereto, first and second pressure arms each pivotably mounted to said turntable wherein first and second cam followers are rotatably mounted to said first and second pressure arms respectively, each cam follower being pressed against said contact surface by a single biasing means and with a force sufficient to cause, in the absence of external force or impediment, an angular acceleration of said turntable, relative to said base, in a direction toward one of said equilibrium orientations.

9. The rotatable display of claim 8 comprising a plurality of equilibrium orientations.

10. The rotatable display of claim 8 wherein there are at least three equilibrium orientations.

11. The rotatable display of claim 8 wherein each equilibrium position is equidistant from adjacent equilibrium positions.

12. The rotatable display of claim 8 wherein the a lower surface of said base is located between about 0.45 inches and about 0.65 inches from said turntable.

13. The rotatable display of claim 8 wherein said display holder has a polygonal cross section and wherein said turntable has a number of equilibrium orientations relative to said base which is determined by the quotient A/B, wherein A is the number of polygonal sides in said polygonal cross section and B is any positive integer which may be divided evenly into A.

14. The rotatable display of claim 8 wherein said angular acceleration is between about 20 and 70 degrees per second per second.

15. The rotatable display of claim 8 wherein said angular acceleration is in a direction toward the nearest of said predetermined equilibrium positions.

* * * * *